US008459412B2

(12) United States Patent
Nickel et al.

(10) Patent No.: US 8,459,412 B2
(45) Date of Patent: Jun. 11, 2013

(54) PORTABLE SCAFFOLD SYSTEM

(75) Inventors: Shane Lorin Nickel, Fargo, ND (US); Jason Michael Solhjem, Kindred, ND (US)

(73) Assignee: Reechcraft, Inc., Fargo, ND (US)

( * ) Notice: Subject to any disclaimer, the term of this patent is extended or adjusted under 35 U.S.C. 154(b) by 82 days.

(21) Appl. No.: 13/007,232

(22) Filed: Jan. 14, 2011

(65) Prior Publication Data

US 2012/0018254 A1 Jan. 26, 2012

Related U.S. Application Data

(60) Provisional application No. 61/295,585, filed on Jan. 15, 2010.

(51) Int. Cl.
*E04G 1/18* (2006.01)

(52) U.S. Cl.
USPC ..... 182/141; 182/17

(58) Field of Classification Search
USPC ..... 182/141, 15, 17
See application file for complete search history.

(56) References Cited

U.S. PATENT DOCUMENTS

| | | | | | |
|---|---|---|---|---|---|
| 73,346 | A | | 1/1868 | Lambs et al. | |
| 132,583 | A | | 10/1872 | Jester | |
| 977,862 | A | | 12/1910 | Grant | |
| 1,347,453 | A | | 7/1920 | Garner | |
| 3,213,965 | A | | 10/1965 | Fedoryk | |
| 3,425,510 | A | | 2/1969 | Fedoryk | |
| 3,452,837 | A | * | 7/1969 | Herrell et al. | 182/17 |
| 3,485,321 | A | * | 12/1969 | Smith, Jr. | 182/131 |
| 3,516,512 | A | * | 6/1970 | Handschack et al. | 182/16 |
| 3,574,981 | A | | 4/1971 | Henschen | |
| 3,741,338 | A | * | 6/1973 | Durand et al. | 182/155 |
| 3,817,006 | A | | 6/1974 | Williams | |
| 3,851,728 | A | * | 12/1974 | Williams | 182/17 |
| D243,853 | S | | 3/1977 | Ejchorszt | |
| 4,068,427 | A | | 1/1978 | Camardo | |
| 4,078,633 | A | * | 3/1978 | Fahy | 182/82 |
| 4,294,332 | A | | 10/1981 | Ready | |
| 4,552,403 | A | | 11/1985 | Yindra | |
| 4,600,085 | A | | 7/1986 | Gagnon et al. | |
| 4,641,728 | A | * | 2/1987 | McCabe | 182/146 |
| 4,887,694 | A | | 12/1989 | Ho | |
| 4,967,733 | A | | 11/1990 | Rousseau | |
| 4,987,976 | A | * | 1/1991 | Daugherty | 187/243 |
| 5,310,018 | A | | 5/1994 | Lahaie | |
| 5,388,663 | A | | 2/1995 | Phillippe et al. | |
| 5,515,941 | A | | 5/1996 | Palmer et al. | |
| 5,909,783 | A | * | 6/1999 | Berish | 182/146 |
| D415,575 | S | | 10/1999 | Nickel | |
| 6,065,254 | A | | 5/2000 | Lanka | |

(Continued)

*Primary Examiner* — Alvin Chin Shue
(74) *Attorney, Agent, or Firm* — Merchant & Gould PC

(57) ABSTRACT

A scaffold system includes first and second spaced apart vertical posts. An upper support device mounts at an upper portion of each of the first and second vertical posts and includes spaced apart arms extending in a first direction from the associated vertical post for engaging the side of a building. A lower support device mounts at a lower portion at each of the vertical posts to support one or more planks and includes outriggers extending laterally and in a second direction opposite the first direction. The outriggers include a wheel mounted near an extended end of each of the outriggers to provide for rolling the system to a worksite. The outriggers may be vertically adjusted and combined in multiple combinations and with multiple arm configurations to adapt to uneven terrain.

20 Claims, 7 Drawing Sheets

U.S. PATENT DOCUMENTS

| | | | | |
|---|---|---|---|---|
| 6,119,605 | A | 9/2000 | Agee | |
| 6,247,273 | B1 | 6/2001 | Nickel | |
| 6,523,647 | B2 | 2/2003 | Duplessis | |
| 6,676,233 | B1 | 1/2004 | Evans et al. | |
| 6,793,039 | B2 | 9/2004 | Schmid, Jr. | |
| 6,981,573 | B2 * | 1/2006 | Nickel | 182/141 |
| 2007/0056802 | A1 * | 3/2007 | Taberah | 182/141 |

* cited by examiner

PORTABLE SCAFFOLD SYSTEM

BACKGROUND OF THE INVENTION

1. Field of the Invention

The present invention relates to a portable scaffold system, and in particular, to a system that may be taken apart with the vertical components configured to be rolled to and from a job site with a base having a wide range of adjustment providing stability over uneven terrain.

2. Description of the Prior Art

Different types of systems are known to provide access for workers to a sidewall or other structure at a raised position. In many small jobs conventional ladders are used. Although ladders are typically quite portable and may be carried to the job site, ladders do not always provide a safe workplace for the user and do not provide a place for tools or materials. In addition, ladders allow access to only a very narrow section of the wall without moving the ladder. Moreover, for jobs that require greater access or lateral movement along the wall, ladders are not suitable.

For larger jobs, scaffold systems are often utilized. Although a scaffold system generally provides a safe working environment for workers at an elevated position, the systems typically require a large framework that is not easily transported and that requires much time for setup and takedown. Larger systems are generally oversized for applications wherein only two-story access is needed and may be impractical for the size of the job and the height requirements.

Other systems are known that provide some portability as an entire framework structure is not needed, but rely on vertical supports that are attached to the side of the building or to the edge of the building roof. Although such systems provide satisfactory access for workers, they have several drawbacks. These systems typically do not provide for easy transportation to and from the job site. Moreover, these systems require attachment to the building or edge of the roof. Screws, nails or other attachments must be fixed to the structure. However, property owners do not want these invasive attachment means damaging their building or roof.

Another common problem with portable scaffold systems is the difficulty in providing a stable system when used over an uneven terrain, especially terrain having a sharp change of elevation. Such changes in elevation are common with some building types such as houses having a walkout basement or structures that use a retaining wall where the elevation of placements for supports may vary by several feet. Easily portable systems do not provide for a base with supports that may engage the ground on a lower section and raised section of the terrain while maintaining stability.

It can be seen that a new and improved support system is needed for providing a raised platform adjacent the side of a structure. Such a system should provide for a safe, raised work area for workers and be easily adjusted to different configurations and provide lateral movement along the wall. Such a system should also be easily portable to and from the job site and allow for quick and simple setup and takedown. Such a system should provide a secure and safe support system without invasive attachment to the building wall. Moreover, such a system should provide for easy adjustment and a wide, safe base over uneven terrain adjacent the side of the building. The present invention addresses these, as well as other, problems associated with raised supporting systems using vertical support posts.

SUMMARY OF THE INVENTION

A support system has vertical support posts, which include adjustable brackets that support at least one plank for workers to walk on, as well as a plank or other structure for holding tools and materials, such as may be used for construction, repair, painting, siding, and other jobs. With this configuration, when the post is tipped over, the vertical assembly may be rolled on the two wheels.

It should be appreciated that the present invention provides for easy setup and takedown, as the vertical post may be rolled to and from the job site and the horizontal planks are easily carried separately. When assembled, the support system provides stability to each of the posts laterally and toward and away from the wall structure.

A lower base includes one or more outrigger assemblies that are mounted to be vertically adjustable on the post. Each outrigger assembly may include up to two outrigger arms with leveling pads at the extended ends of the arms. Moreover, multiple outrigger assemblies may be mounted on each post and may be at the same or different elevations. In this manner, a stable base is obtained even over uneven terrain as the outrigger assemblies may be adjusted to the proper height to ensure stability.

Each leveling pad is adjustably mounted on an outrigger so that when the pads are adjusted, the post extends in a straight vertical direction while the outrigger system provides a wide, stable base. The outrigger assembly may be configured as a pair in a V configuration. In other configurations, three or four outrigger arms may be utilized and configured differently, such as in an X. Each outrigger assembly is independently vertically adjustable on the post to adjust to changes in the terrain.

While the lower outrigger base structure provides support laterally and outwardly from the wall, the present system also includes an upper stabilizing device. The upper stabilizing device includes a pair of arms extending inward from the post, and configured to engage the wall. The upper stabilizer includes spaced-apart arms that extend inward toward the wall, and are space laterally outward from the post. The upper stabilizer is vertically adjustably mounted on the vertical post element to adapt to different shapes and structures.

In use, the vertical post elements have the lower base and the upper stabilizer mounted thereto and the assembly is rolled on wheels of the outrigger portion of the base to the job site. The posts are tipped and raised to a vertical position so that the upper stabilizer engages the face of the building and spaces the vertical post elements at a proper distance from the wall. The outrigger assemblies and the leveling pads are then positioned and adjusted to provide a stable base with the posts vertical. In one embodiment, the leveling pads are threadably mounted to the outrigger arms. Therefore, as the threaded portion is rotated, the pads extend or retract depending on the direction of rotation. In one embodiment the mounting pads are raised or lowered by actuation from a portable rotary driver, such as a portable drill.

When the vertical assemblies are placed, leveled and supported in the proper stable manner, the horizontal planking may be placed on brackets on each of the two vertical assemblies. The horizontal planking extends between the vertical assemblies and provides additional support to the system. The portability of the present system allows for moving one post along the wall while leaving on post, so that the plank may simply be moved and workers may work their way along the wall of a structure. With such a configuration, the vertical assembly is rolled along the wall, and the plank is just moved from one end to the other of the vertical assembly that is not moved.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference letters and numerals indicate corresponding structures and elements throughout the several views.

DETAILED DESCRIPTION OF THE PREFERRED EMBODIMENT(S)

Figure 1:
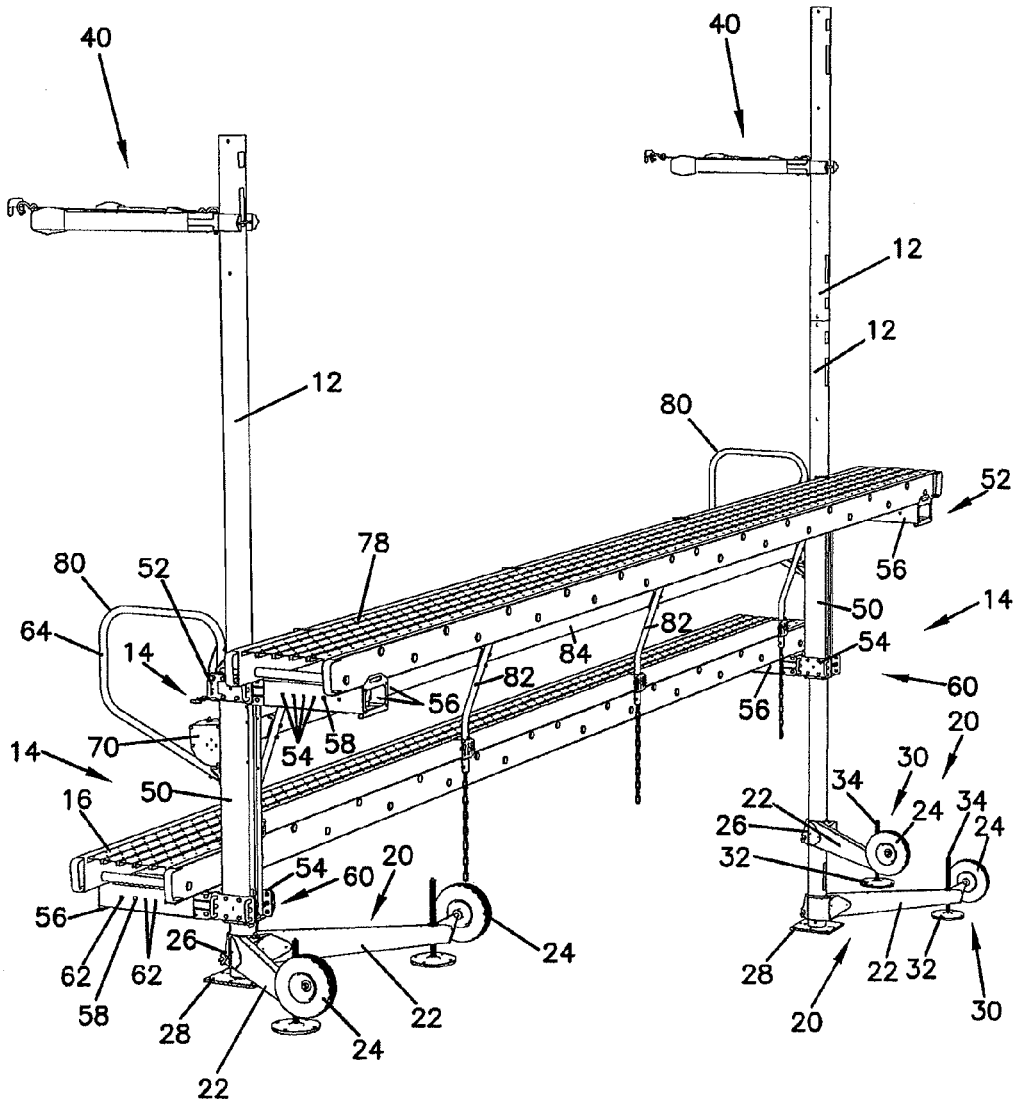
FIG. 1 is a first perspective view of a portable raised support system according to the principles of the present invention.
Figure 2:
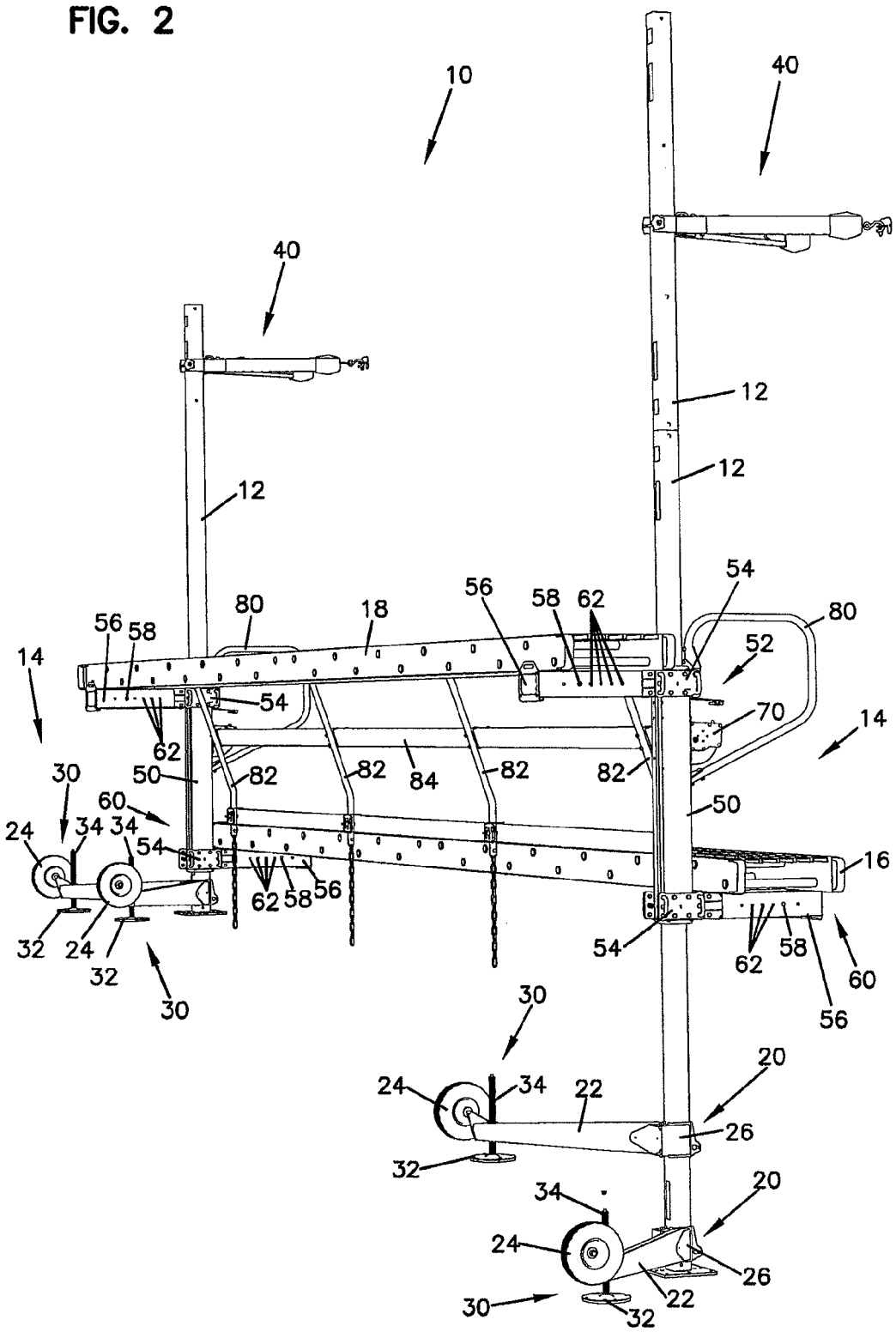
FIG. 2 is a second opposite end perspective view of the support system shown in FIG. 1.

Referring now to the drawings and in particular to FIGS. 1-4, there is shown a portable raised support system, generally designated 10. The system includes at least two vertical post members 12. Each of the vertical posts 12 has a bracket support assembly 14 adjustably mounted thereon. The support assembly 14 supports planks 16 and 18 on opposite or both sides of the vertical posts 12. The planks 16 and 18 extend between the posts 12 and provide for a safe walking and work surface for workers as well as raised surface for supporting tools, materials, and other objects as may be needed in an easily accessible location. The posts 12 may be formed of sections of common lengths, such as 6 feet or 12 feet that may be added end to end to create the needed post height.

The raised support system 10 is configured for mounting against a structure 100 such as a building, and providing a safe, elevated, and stable work area. The structure generally includes a wall 102 with a roof 104 that may extend outward from the wall 102 and having a roof facing 106. This system is generally configured for mounting next to the wall 102 with upper stabilizer assemblies 40 configured for mounting against the wall 102 and below the roof 104, as explained hereinafter.

The system 10 is generally supported on a base including one or more outrigger assemblies 20 associated with each of the vertical posts 12. Each base assembly 20 includes one or two horizontally extending arms 22, with two arms 22 generally arranged in a diverging configuration. When the vertical post members 12 are deployed for use, the outrigger arms 22 generally extend laterally outward and away from the structure 100. At an extended end of each of the arms 22 is mounted a wheel 24. The base assembly 20 is configured so that when the vertical posts 12 are tipped over, the wheels 24 engage the ground so that the vertical posts 12 may be rolled to and from the job site. It should be appreciated that the vertical post assembly 12 is sufficiently light so that one person may transport the supported system on one end by the wheels 24 with the opposite end supported by the single worker. Moreover, one person can safely tip the vertical posts up and down.

Figure 3:
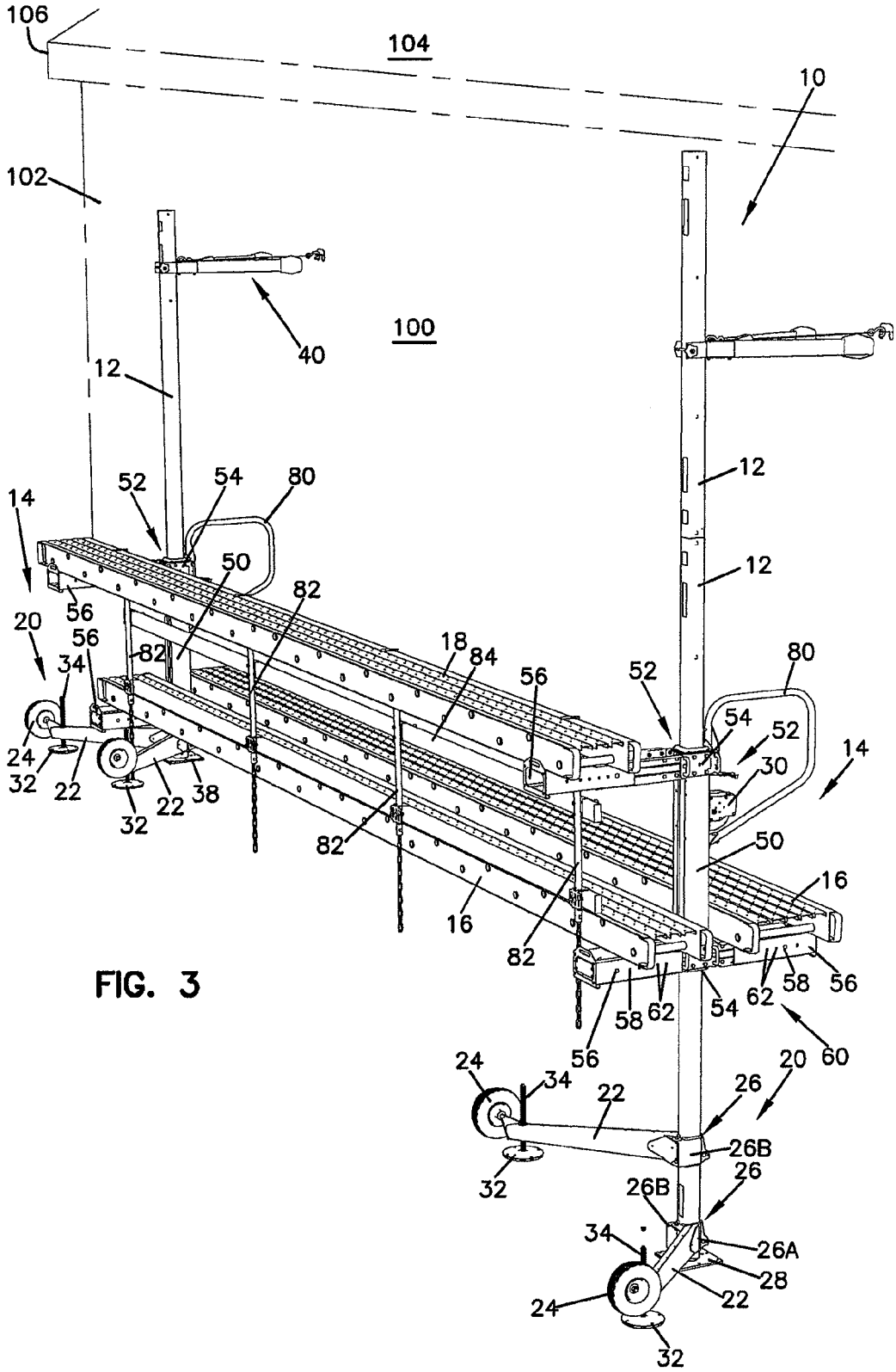
FIG. 3 is a perspective view of the support system shown in FIG. 1 with an additional support plank.
Figure 4:
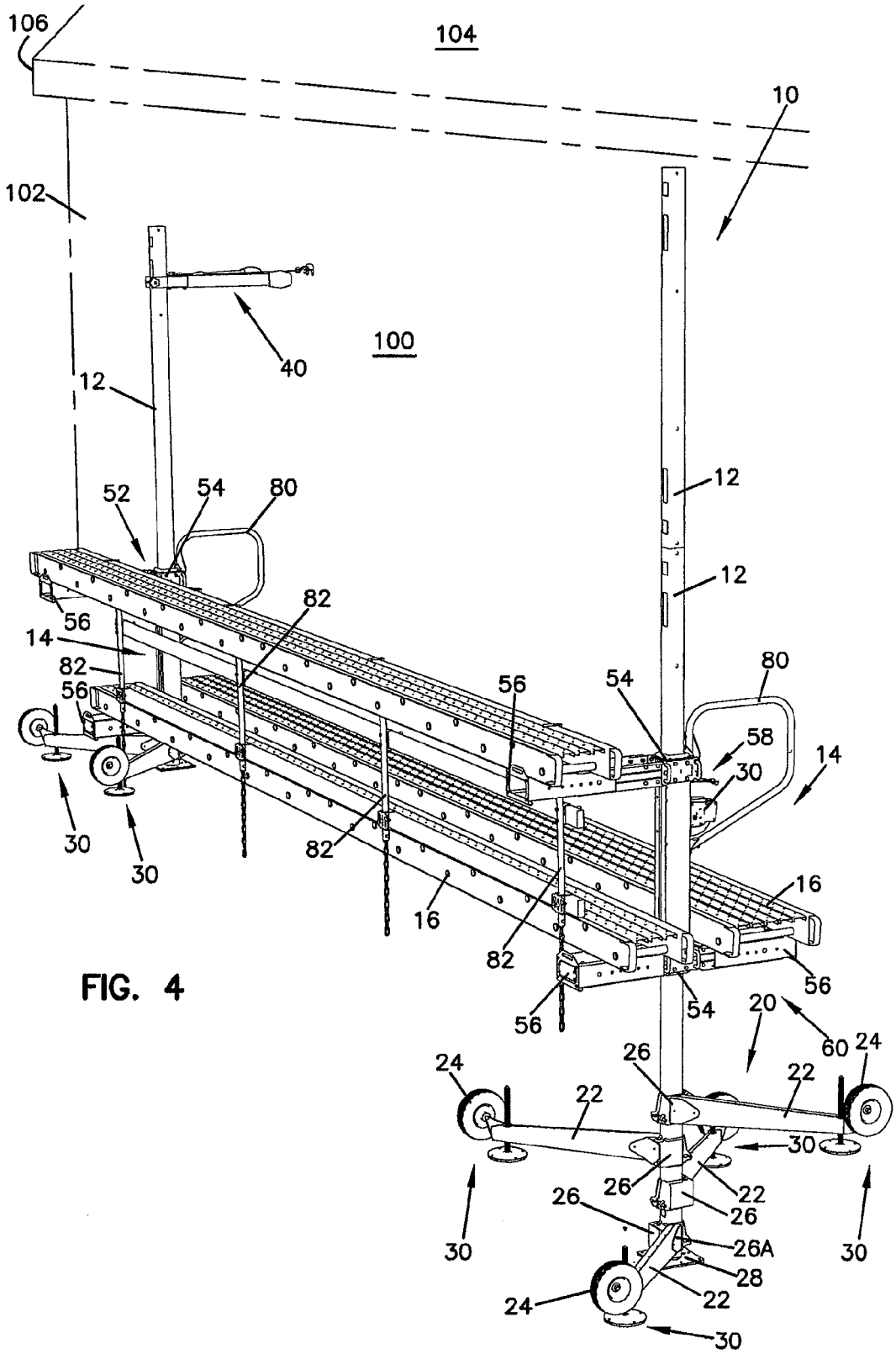
FIG. 4 is a perspective view of the support system shown in FIG. 3 with multiple outrigger assemblies mounted on one post.
Figure 5:
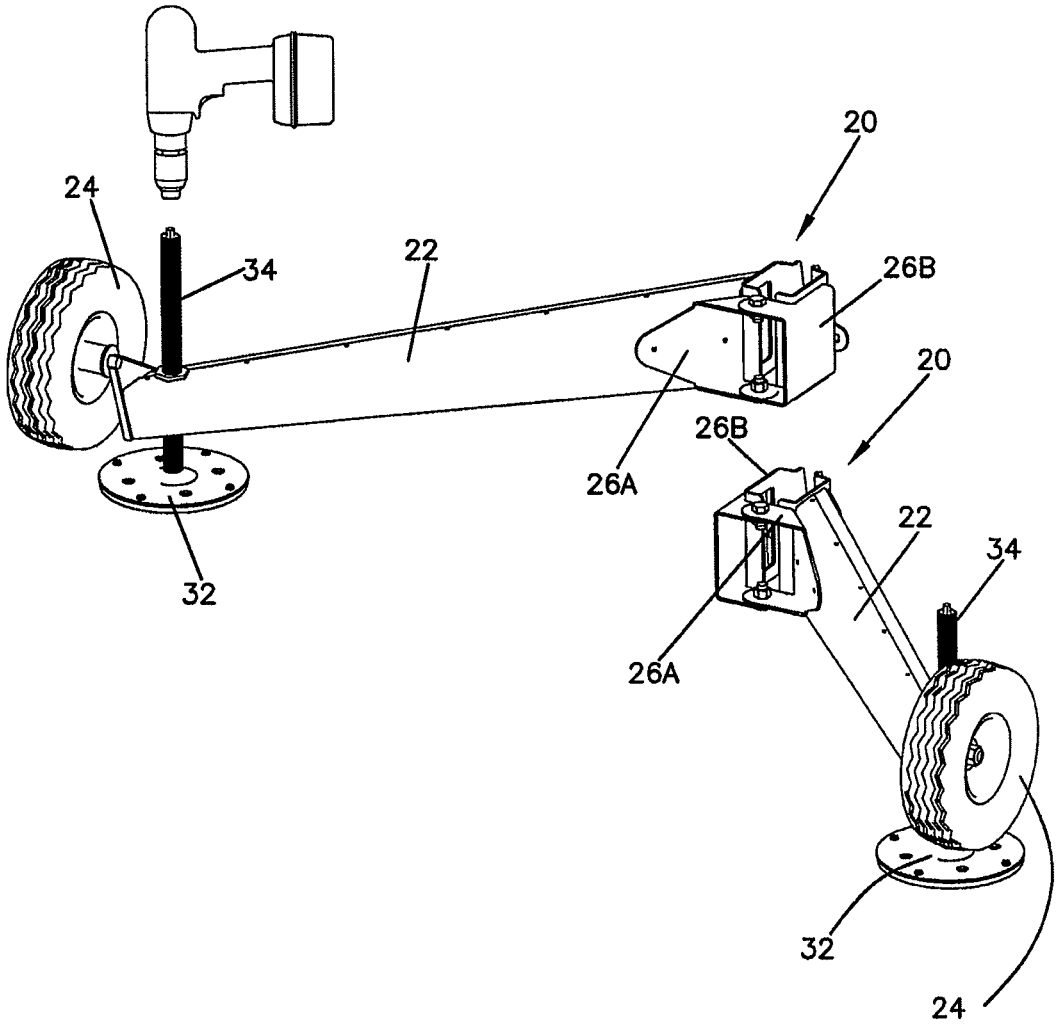
FIG. 5 is a perspective view of outrigger assemblies for the support system shown in FIG. 1.
Figure 7:
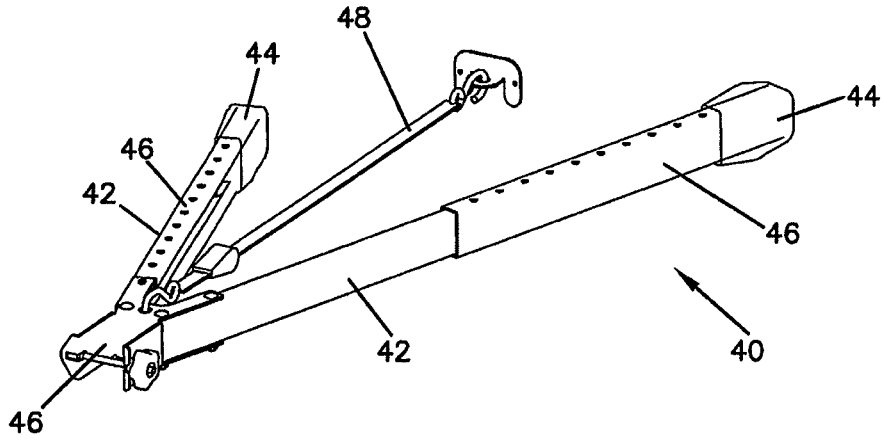
FIG. 7 is a perspective view of an upper stabilizer for the support system shown in FIG. 1.
Figure 6:
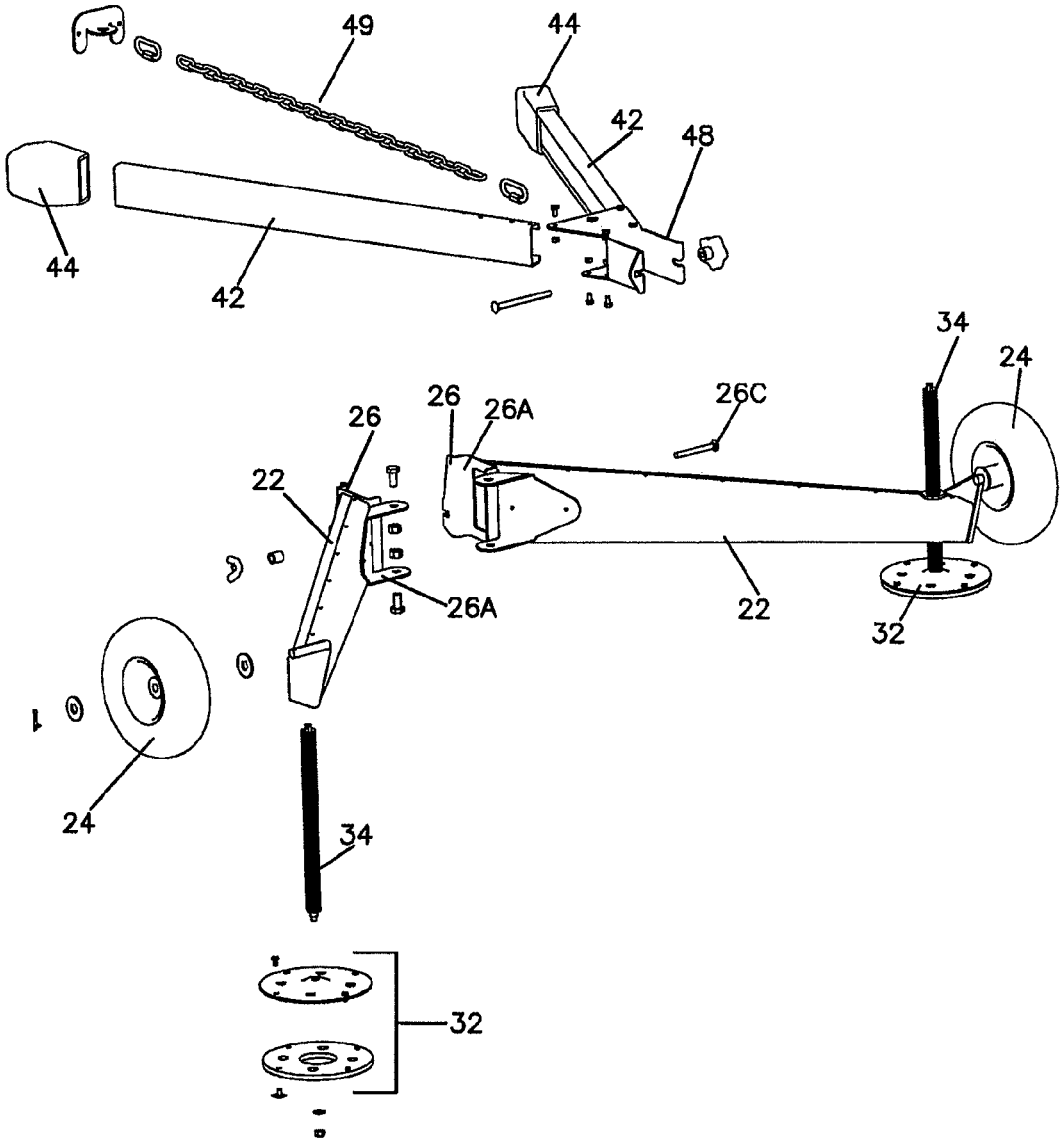
FIG. 6 is an exploded view of the outrigger assemblies shown in FIG. 5.

As shown in FIGS. 1-4, when configured for use, the vertical post 12 is tipped upward and supported in part on a base pad 28. The base assembly 20 includes a mount 26 attached to the associated post 12. The outrigger assemblies 20 are vertically adjustable on the post 12 and may be combined in arm pairs or single arms or combined with other outrigger assemblies 20 to adapt to uneven terrain, such as shown in FIG. 4. The mount 26 includes first attachment members 26A for use with two outrigger arms 22 on an outrigger assembly 20 or a first attachment member 26A and complementary member 26B when a single arm 22 is used with an outrigger assembly 20 as shown in FIGS. 5 and 6. Pins 26C hold the arms 22 in the mount 20 at the deployed position relative to the post 12. A leveler assembly 30 includes a pad 32 and associated threaded adjustable member 34 mounted at the extended end of the arms 22 near the wheels 24. The leveler assemblies 30 are independently adjustable by rotating the threaded member 34 and provide for fine adjustment of the base. It can be appreciated that rotation in a first direction extends the associated pad 32, while rotation in an opposite direction retracts the pad 32. In this manner, the vertical post 12 may be plumbed so as to be vertical by adjusting each of the pads 32. With this configuration, the base pad 28 and the two pads 32 on the arms 22 form a wide, stable triangular support or other stable support configuration for each of the vertical post assemblies 12.

The leveler assemblies 30 may be actuated by a portable rotary driver device, such as a cordless drill. The adjustment takes place by simply attaching the drill to the threaded member 34 and actuating the drill to rotate the threaded member in the desired direction to raise or lower the pad 32.

Figure 8:
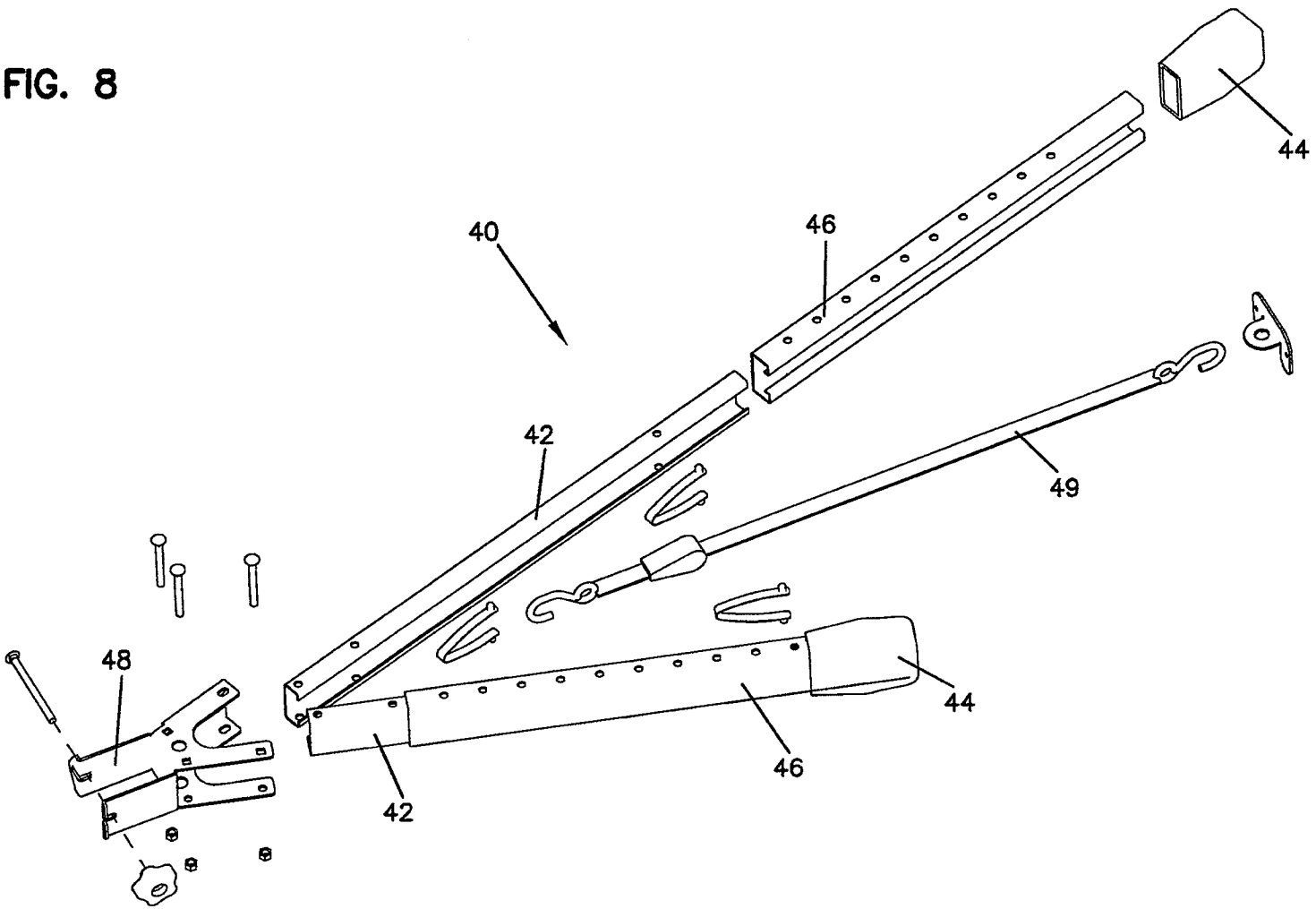
FIG. 8 is an exploded view of the upper stabilizer shown in FIG. 7.

In addition to providing a stable base 20, the system 10 may utilize an upper stabilizer assembly 40 shown in FIGS. 8 and 9 associated with each post member 12 to provide for engagement with the wall 102 so that the upper portion of the vertical post assembly 12 is also fully supported. It can also be appreciated that with the upper stabilizer assembly 40 engaging the wall 102 at a first side of the vertical post and the base assembly 20 including pads 32 at the opposite side of the vertical post and both assemblies 20 and 40 extending laterally outward from the vertical post 12, the vertical post assembly 12 is provided with a stable, rigid support extending outward in all directions. The upper stabilizer assembly includes arms 42 mounted to an adjustable mount 48 attached to the associated vertical post 12. The upper stabilizer assembly 40 is adjustably mounted on the associated vertical post 12 so that the stabilizer assembly 40 may be positioned at a desired elevation. Pads 44 at the ends of telescoping portions 46 of the arms 42 are configured for engaging the wall 102 of the structure 100. As each of the arms 42 is extensible, the upper stabilizer assembly 40 is adjustable in a direction toward the structure 100 as well as laterally to provide flexibility for mounting to different spaces. In some configurations, the upper stabilizer assembly 40 may include an attachment device 49, such as a chain or strap that attaches to a member mounted on the wall. The upper stabilizer assembly 40 is generally positioned near the upper end of the post 12 and below and close to the underside of the roof 104.

As shown in FIGS. 1-4, the plank support assemblies 14 include a vertical section 50 attached to an upper support bracket 52 and a lower support bracket 60. The upper and lower support brackets 52 and 60 include a telescoping retainer 56 with an end lip that is adjustably movable to adapt to the width of the associated plank. In this manner, each plank 16 or 18 is positively engaged and retained. The retainer 56 can be moved toward or away from the post 12 by changing the position of adjustment pins 58 inserted into adjustment holes 62. The retainers attach to universal mounts 54 that allow for attaching the retainers 56 in multiple positions or to attach multiple retainers to a mount 54, as shown in FIGS. 3 and 4. In this manner, multiple planks 16 or 18 may be supported on both sides of a post 12.

The plank support assembly 14 also includes a drive unit 70 that engages the associated vertical post 12 for movement vertically along the post to change the position of the assembly. Examples of such a drive device are shown in U.S. Pat. No. 6,981,573, incorporated herein by reference. It can also be appreciated that other similar types of drives that include teeth or other engagement devices for moving vertically along the associated post 12 may also be used. In one embodiment, the drive unit 70 is also actuated by the rotary driver device such as a cordless drill. To actuate the drive unit 70, the drill engages a drive system to move the support assembly 14 upward with rotation in a first direction and downward with rotation in the opposite direction. End safety rails 80 and one or more vertical safety bars 84 supported on brackets 82 are added to minimize open spaces and decrease the chances of falling.

In use, the vertical post assemblies 12 are rolled to the work site on the wheels 24 of the base 20. The outrigger assemblies 20 are positioned at desired positions along each post 12 to match the terrain. The vertical post assembly 12 is then tipped up to a use position such as shown in FIGS. 1-4. The leveling pads 32 are adjusted by extending or retracting the threaded member 34 to the desired position with the cordless drill. When the base is stable and the vertical post 12 is plumb, the upper stabilizer 40 may be moved to the desired height. This can be done by a worker standing on the plank support assembly 14 and engaging the drive unit 70 with the drill to lift the worker to an elevation for accessing the upper stabilizer assembly 40. The adjustable mount 48 is then loosened, and the worker may move the upper stabilizer 40 to the desired elevation. When the upper stabilizer 40 is at the desired elevation, the adjustable mount 48 is then tightened. If utilized, the attachment device 49 is secured to the wall. The bracket assemblies 14 are each then lowered by engaging the drive unit 70 with the drill 36 to a position wherein the planks 16 and 18 may be placed on the support brackets 52 and 60, respectively. The safety rails 80, brackets 82 and bars 84 are placed on the system for improved safety. The plank support assemblies 14 are then moved to the desired elevation with the tools and materials supported on the upper plank 16. Workers may continue to adjust the position of the planks 16 and 18 forming the scaffold assembly by engaging the drive unit 70 to raise and lower each of the support assemblies 14 and may change the configuration by adding or removing retainers 56 and planks 16 and 18. The elevation may be continuously adjusted as the work varies, so the height of the workers may be adjusted on the fly for the particular job.

It can be appreciated that the planks 16 and 18 may be moved along the wall so that work may continue in a horizontal direction from one end of the structure to the other end. In one method, one of the vertical posts 12 remains in a supportive position while the other post is lowered and rolled to the next desired position further along the building 100, with the planks simply being moved along the wall 102. This continues with the posts being alternated in their movement and the planks 16 and 18 being moved as the job works its way along the wall 102.

In order to lower the system and transport it away from the job site, the planks 16 and 18 are removed from the support assemblies 14. For some configurations, one or more upper sections of the posts 12 may also be removed and transported separately. Each of the vertical posts 12 can be moved by retracting the leveling pads 32 so that the wheels 24 engage the ground. The post assembly 12 may then simply be tipped over with a worker supporting the upper end of the post 12 near the stabilizer 40 while the lower end is supported on the wheels 24 of the base 20. The posts 12 may then be easily rolled for transport away from the job site. The stabilizer assembly 40 and the base assembly 20 may also be mounted so as to be removable from the post 12 so that the entire system 10 may be disassembled for easier transport.

It can be appreciated that the present invention provides for a lightweight and easily transported support system 10. The support system provides for adjustment of the support elements to provide a safe, stable support for the system and for easy adjustment of the vertical position of the working support planks 16 and 18. Moreover, the present invention provides a stable support that does not require invasive attachment to the wall 102 or roof facing, as required by other systems.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. A portable support system, comprising:

a vertically extending post device defining a first forward side, a second rear side and lateral sides;

an upper support device attaching to the first side of the post device, including a pair of engagement arms on the lateral sides of the post device and extending forward;

a lower base including:

first and second outriggers mounted at a first end to the post device and extending outward laterally and rearwardly from the post device, each of the first and second outriggers including a vertically adjustable mount attaching to a lower portion of the post device, the first and second outriggers being independently vertically positionable on the post device; a rolling member mounted at a second end of each outrigger; and a leveling pad adjustably mounted proximate a second end of each of the outriggers.

2. A portable support system according to claim 1, wherein the leveling pad threadably mounts to the associated outrigger.

3. A portable support system according to claim 2, wherein the leveling pad is configured for actuation by a portable rotary driver.

4. A portable support system according to claim 1, further comprising a first bracket on the first side configured for supporting a horizontal plank member.

5. A portable support system according to claim 4, further comprising a second bracket on the second side configured for supporting a horizontal plank member.

6. A portable support system according to claim 1, further comprising third outrigger and fourth outriggers adjustably mounted to the vertically extending post device.

7. A scaffold system comprising:

a first vertical post;

a second vertical post;

an upper support device mounted at an upper portion of each of the first and second vertical posts, the upper support device including spaced apart arms extending in a first direction from the associated vertical post;

a lower support device mounted at a lower portion at each of the vertical posts, the lower support device including a plurality of outriggers extending laterally and in a second direction opposite the first direction, each of the plurality of outriggers being independently vertically adjustable on the vertical posts; a wheel mounted proximate an extended end of each of the outriggers.

8. A scaffold system according to claim 7, further comprising a leveling pad mounted proximate the extended end of each of the outriggers.

9. A scaffold system according to claim 8, wherein each of the leveling pads is adjustably mounted to the associated outrigger.

10. A scaffold system according to claim 9, wherein the leveling pad threadably mounts to the associated outrigger.

11. A scaffold system according to claim 10, wherein the leveling pad is configured for actuation by a portable rotary driver.

12. A scaffold system according to claim 7, further comprising a plank support assembly mounted to each of the vertical posts and having a first bracket supporting a first horizontal plank member.

13. A scaffold system according to claim 12, wherein the plank support assembly further comprises a second bracket mounted to each of the vertical posts and supporting a second horizontal plank member.

14. A scaffold system according to claim 12, wherein the plank support assembly is adjustably mounted on the vertical posts.

15. A scaffold system according to claim 14, wherein the plank support assembly comprises a hand held rotary actuator for adjusting a vertical position of the assembly.

16. A scaffold system according to claim 14, wherein the plank support assembly brackets comprise horizontally adjustable side retainers.

17. A scaffold system according to claim 7, wherein the respective upper support devices are vertically adjustably attached to the first and second vertical posts.

18. A scaffold system according to claim 7, wherein the spaced apart arms of the upper support devices are adjustably extensible.

19. A scaffold system according to claim 7, wherein the spaced apart arms of the upper support devices are adjustably extensible and the upper support devices are vertically adjustably attached to the first and second vertical posts.

20. A scaffold system according to claim 7, further comprising third outrigger and fourth outriggers independently positionable on at least one of the vertically extending post devices.

* * * * *